United States Patent [19]

Aloi et al.

[11] 4,299,158

[45] Nov. 10, 1981

[54] LAST ROUND DETECTION DEVICE

[75] Inventors: Anthony J. Aloi, Richmond; Robert J. Fritz, Burlington, both of Vt.

[73] Assignee: The United States of America as represented by the Secretary of the Air Force, Washington, D.C.

[21] Appl. No.: 97,462

[22] Filed: Nov. 26, 1979

[51] Int. Cl.[3] ..... F41D 10/26; F41D 10/30

[52] U.S. Cl. ..... 89/137; 89/33 D

[58] Field of Search ..... 89/33 D, 137

[56] References Cited

U.S. PATENT DOCUMENTS 2,993,415 7/1961 Panicci et al. ..... 89/33 D

*Primary Examiner*—Stephen C. Bentley

*Attorney, Agent, or Firm*—Donald J. Singer; Arsen Tashjian

[57] ABSTRACT

The device is for use with an ammunition storage drum for a modern multi-barrel high rate-of-fire machine gun (i.e., "Gatling" type gun) system, in which unfired ammunition rounds are transported from the drum to the gun, and the cases of the spent ammunition are returned from the gun to the drum. When two generally, oppositely positioned spent ammunition sensors within the drum simultaneously detect spent ammunition in the drum, a signal is sent to the gun control unit in time to cut off power. The device prevents spent ammunition from being chambered in the gun, and as a result also permits higher rates-of-fire by the gun.

6 Claims, 6 Drawing Figures

FIG. 1
PRIOR ART
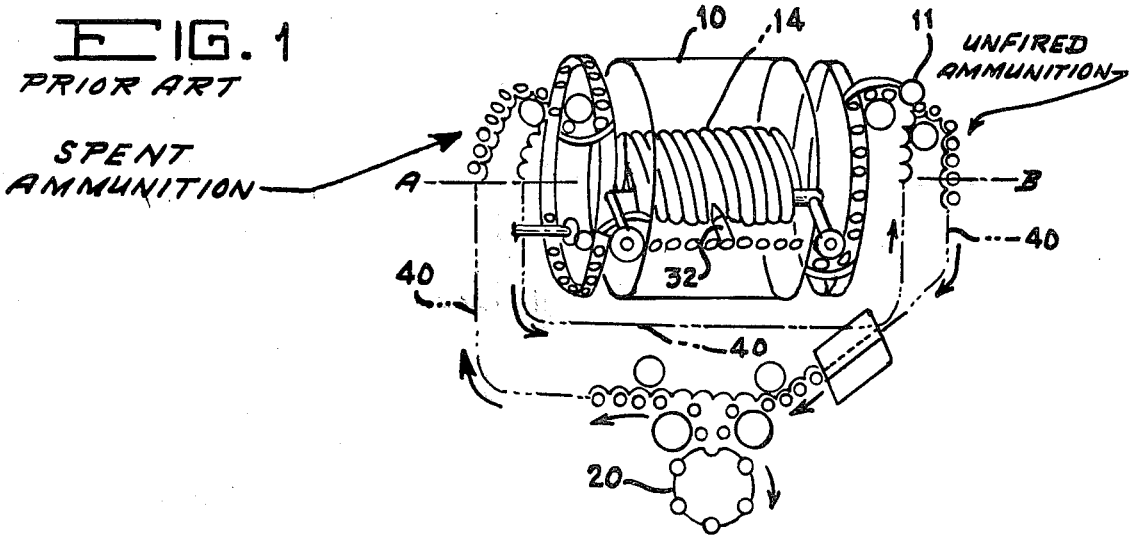
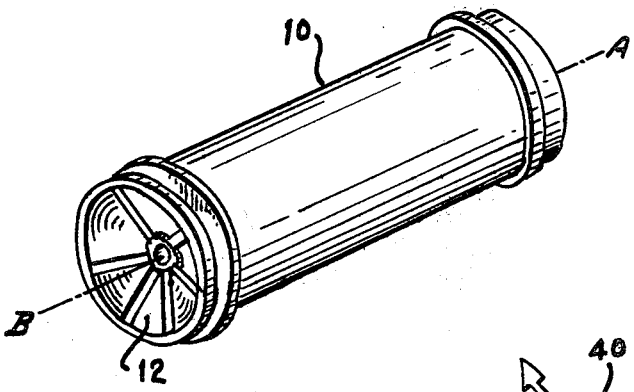
FIG. 2-A
PRIOR ART
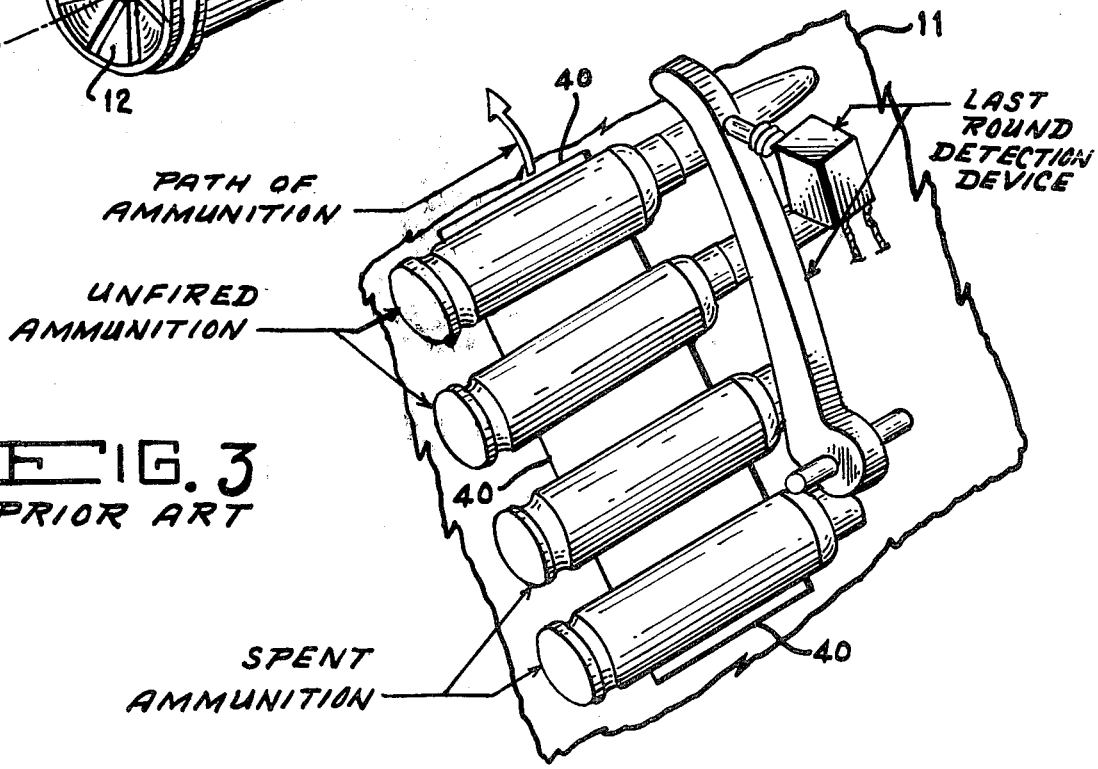
FIG. 3
PRIOR ART

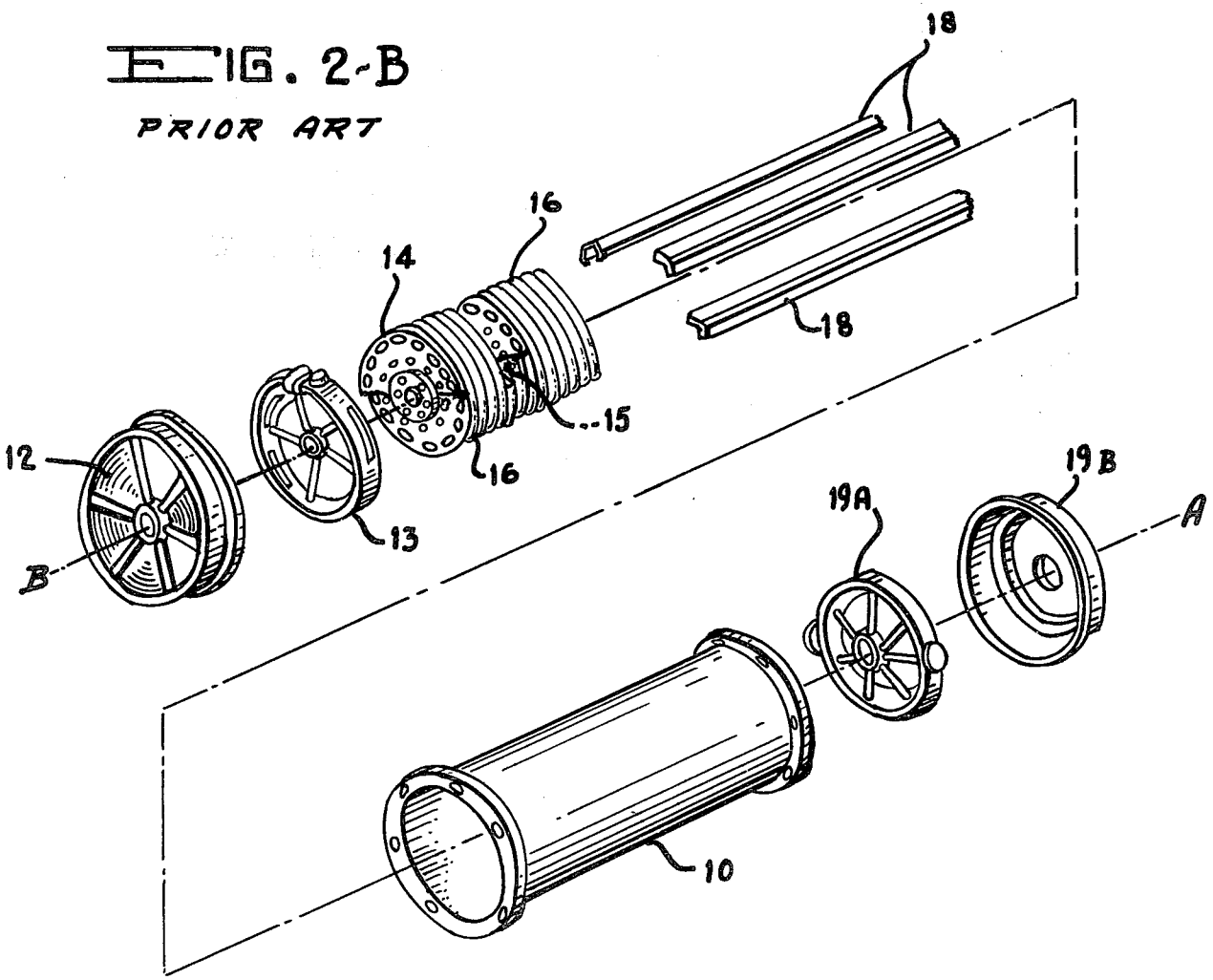
FIG. 2-B
PRIOR ART

LAST ROUND DETECTION DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates to a last round detection (i.e., sensing) device and, more particularly, to such a device that is for use with an ammunition storage drum for a modern multi-barrel high rate-of-fire machine gun, such as the 30 mm, Model GAU-8 ("Gatling" type) manufactured and sold by the General Electric Company, Burlington, Vt. 05401.

In ammunition storage devices or reservoirs of the drum type for modern multi-barrel high rate-of-fire machine guns, rounds of ammunition are stored within the ammunition storage drum in abutting positions and around a helical-like core member. As the core member is rotated, the rounds are individually transported to an outlet in the drum. Flexible ammunition chuting is interposed between, and is connected to, the outlet of the ammunition storage drum and the receiver of the gun; and, the chuting is used for handling and transporting the rounds of unfired ammunition from the drum to the gun, and the cases of spent ammunition from the gun back to the drum.

Since the gun fires at a high rate-of-fire, there is the possibility that spent cases which have been returned to the drum will be transported again to the gun and chambered. Obviously, this is undesirable, and to prevent it, prior art "last round" sensing devices, which cut off power to the gun after sensing the last round, have been positioned in the outlet (hereinafter referred to as the "exit" or "exit unit"), FIG. 3, to prevent this occurrence. Although these prior art sensing devices are satisfactory at the present high rates-of-fire, they would not be at higher rates-of-fire, where the length of the flexible ammunition chuting (and the time involved in moving ammunition through this length of chuting) from the exit unit to the gun is very short.

What is needed at contemplated higher rates-of-fire to prevent the chambering of cases of spent ammunition, and is not presently available, is a last round detecting (i.e., sensing) device which will sense the last round a sufficiently long lead time before it reaches the exit unit during the overrun after power cut off.

With our inventive last round detection device we have fulfilled that need; and, thereby, we have significantly advanced the state-of-the-art.

SUMMARY OF THE INVENTION

Accordingly, the principal object of this invention is to provide a last round detection device which uniquely detects the passage of the last round sufficiently before it leaves the ammunition storage drum from the exit unit to permit the timely cut off of power to the rotating helix within the ammunition storage drum (or, more accurately, to the gun) to prevent the chambering of cases of spent ammunition into the gun.

This principal object, as well as other related objects, of my invention will become readily apparent after a consideration of the description of the invention, together with reference to the Figures of the drawings.

DESCRIPTION OF THE DRAWINGS

FIG. 1 is a side elevation view, in simplified schematic form, showing the operative interconnection and cooperation by and between a typical modern multi-barrel high rate-of-fire machine gun, a typical ammunition storage drum, and a typical flexible ammunition chuting therebetween;

FIG. 2A is a perspective view, in simplified pictorial form, of the exterior of the typical ammunition storage drum shown in FIG. 1, and, FIG. 2B is also a perspective view in simplified form of that same drum, but in an exploded condition;

FIG. 3 is a perspective view, in simplified form, of a typical prior art last round detection device located in its environment in the exit unit external of the ammunition storage drum;

DESCRIPTION OF THE PREFERRED EMBODIMENT

Figure 4:
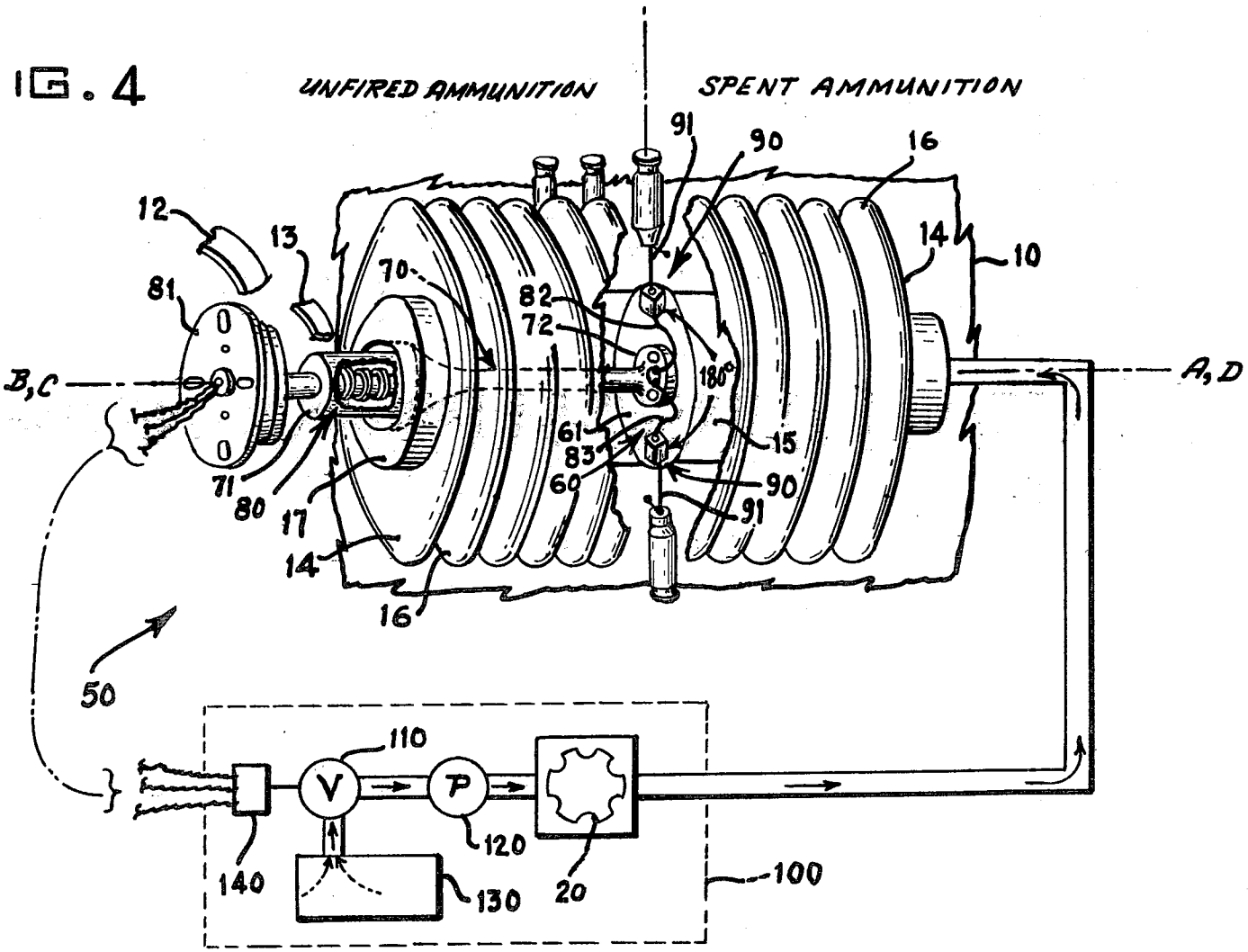
FIG. 4 is a side elevation view, partially in perspective, and in simplified schematic and pictorial form, of a preferred embodiment of my invention in its environment, principally within the helix internal of the ammunition storage drum.

As a preliminary matter, and with reference to FIGS. 1–5, inclusive, it is to be noted and remembered that my invention is intended for use with an ammunition storage drum (such as 10, FIGS. 1, 2A, 2B and 5) for a modern multi-barrel high rate-of-fire machine gun, such as the General Electric Company 30 mm, GAU-8 "Gatling" which is designated 20 in FIGS. 1 and 4. It is to be assumed that the ammunition storage drum 10 (hereinafter referred to as the "drum") contains unfired ammunition rounds (such as 30, 30A, 31, 31A, 32 and 32A, FIG. 5), including a last round (such as 32, FIGS. 1 and 5), with each unfired round having a case member (such as 33B, FIG. 5, for round 32) and a nose member, i.e., a projectile (such as 33A, FIG. 5, for round 32) releasably fitted and connected to the case member 33B.

Figure 5:
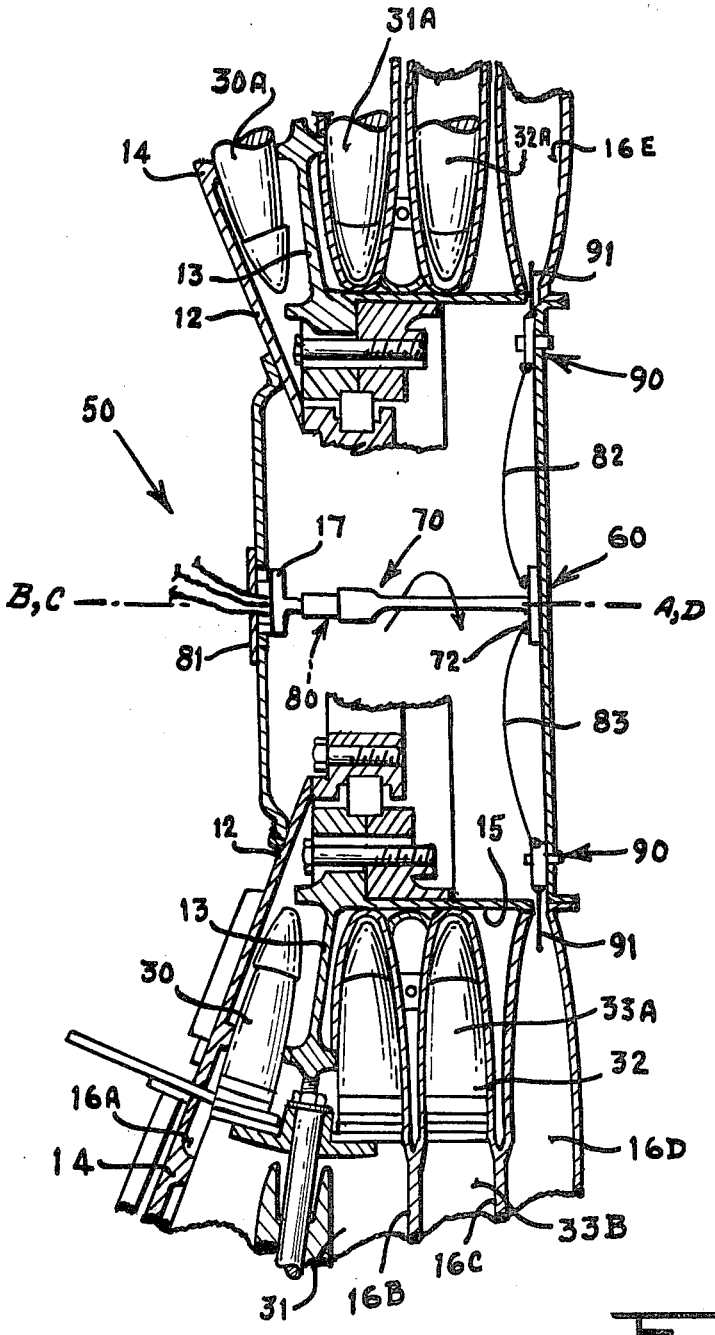
FIG. 5 is another side elevation view, partially fragmented, and in simplified schematic and pictorial form, of a preferred embodiment of my invention also in its environment, principally within the helix internal of the ammunition storage drum.

The drum 10 has a longitudinal axis A-B, FIGS. 1, 2A, 2B and 5, and an ammunition exit unit 11, FIGS. 1 and 3, and includes an exit drum cover 12, FIGS. 2A, 2B, 4 and 5, an exit scoop disc 13, FIGS. 2B, 4 and 5 and an internal rotatable helix 14, FIGS. 1, 2B, 4 and 5, with a core 15, FIGS. 2B, 4 and 5, and with convolutions (such as 16, FIG. 2B, and more specifically such as 16A, 16B, 16C, 16D, and 16E, FIG. 5) carrying unfired ammunition rounds, including last round 32 in helix convolution 16C, FIG. 5. The drum 10 also has, as shown in FIG. 2B, drum partitions 18, an ammunition entrance scoop disc 19A and an ammunition entrance drum cover 19B.

The drum 10 is operatively connected to means (such as 40, FIGS. 1 and 3) for handling and transporting the unfired ammunition rounds, including the last round, to the gun 20, FIGS. 1 and 4, and for handling and transporting case members of spent ammunition rounds from the gun 20 to the drum 10. This means may comprise an endless chain of flexible ammunition chuting.

In the most basic and generic structural form, the preferred embodiment 50, FIGS. 4 and 5, of our invention comprises: a support means 60 disposed internal of the helix 14 and connected to (or, preferably, mounted on) it; a tube assembly 70 that extends through the exit scoop disc 13, and inwardly into the drum 10 and into the helix 14 and helix core 15, and is attached to the support means 60; a self-contained electrical slip ring assembly 80 which is secured onto the exit drum cover 12 and "plugs into" the tube assembly 70; and, a plurality (preferably two) of means 90 (preferably of the switch type) for sensing the presence or absence of the nose member, such as 33A, of each round of ammunition in the helix convolutions, such as last round 32 in helix convolution 16C, with each means 90 linked to the self-contained slip ring assembly 80.

More specifically, the support means 60 is a bracket assembly which includes a round plate 61 that is vertically positioned with reference to tube assembly longitudinal axis C-D, and is mounted on the core 15, inside the helix 14. Its function is to support the tube assembly 70.

The tube assembly 70 houses and supports the slip ring assembly 80, and it has a first end 71, a second end 72, and as previously stated a longitudinal axis C-D. The tube assembly 70 is disposed such that the longitudinal axis A–B of the drum 10 and the longitudinal axis C-D of the tube assembly 70 are coincident. The tube assembly 70 is attached to the support means 60 by the second end 72, and passes through (and in turn is supported by) the helix exit end plate 17.

The self-contained electrical slip ring assembly 80 is releasably secured to the exit drum cover 12 (preferably by and with a stationary mounting plate 81), and is inserted into the tube assembly 70 through the first end 71. The slip ring assembly 80 is linked, by suitable means whether it be electric, electro-mechanical, fluid or the like, or a combination thereof, to a suitable power means (such as 100) which, ultimately, drives the helix 14, causing the helix 14, the core 15, and the convolutions 16A, 16B, 16C, 16D and 16E, and the like, to rotate and deliver the unfired ammunition rounds to the gun 20.

It is here to be noted that the gun 20 may be operated, or cause to be operated by, a number of different power means, (such as 100, FIG. 4), which may consist of electrical means, electro-mechanical means, hydraulic means, gas means, or the like, or a combination thereof. Since it is the operation of the gun 20 which ultimately powers the helix 14 (and the core 15 and the convolutions 16A–16E, inclusive), it becomes apparent that the power means 100 powers both the gun 20 and the helix 14.

For illustrative reasons, and not because of any limitation, a typical power means 100 is shown, as previously indicated, in FIG. 4. As can be seen, the power means 100 is a hydraulic one, and is electrically connected with a suitable conventional logic circuit 140. In turn, the circuit 140 is linked to and controls a flow control valve 110 which, in turn, controls the flow from a hydraulic (fluid) reservoir 130 to a hydraulic pump 120 that ultimately powers and drives the helix 14, through the action of the gun 20, causing the helix 14 (and the core 15 and the convolutions, such as 16A, 16B, 16C, 16D, and 16E) to rotate.

The plurality of switching means 90 preferably are: two in number; electro-mechanical in structure (rather than solely electrical, electronic, and the like); and, identical. Each means 90 is mounted, on the support means 60 internal of the helix 14, are disposed at a preselected angle from each other (preferably in a generally opposite position to each other, i.e., about 180 degrees apart) as will later be explained. This disposition is such as to monitor the helix core 15, in between the helix convolutions (such as 16A, 16B, 16C, 16D and 16E) for the presence or absence of the nose member of all rounds of ammunition in the helix. Each sensing means 90 is in electrical connection with the self-contained slip ring assembly 80, as is indicated by electrical wires 82 and 83, FIGS. 4 and 5. Additionally, each sensing means 90 includes a feeler extension (such as 91, FIGS. 4 and 5) which protrudes through the helix core 15 in between the helix convolutions, as is best shown in FIG. 5, to sense (i.e., detect) the presence or absence of the nose member of each round of ammunition. It is here to be noted that the preselected angle requires that both of the switching means 90 not be sensing at a position in between projectiles at the same time, thereby shutting the system off when rounds still remain to be presented to the gun and having the feed mechanism cycled repeatedly because the presence of a projectile will then operate the switch to its on position. Alternatively, the end of the feeler extension 91 from the switch 90 could be bent such that the free end is orthogonal to the straight portion attached to the switch and directed upstream to form an L (FIG. 4) to cover the pitch distance between rounds. Thus, when a round is moving under the switch feeler element 91, it maintains contact with the feeler extension for a sufficiently long period to avoid an erroneous reading indicating an absence of a round. In FIG. 5 the feelers 91 are extended into helix convolutions 16D and 16E that are carrying spent ammunition rounds which, of course, do not have a nose member.

MANNER OF OPERATION OF THE PREFERRED EMBODIMENT

The manner of operation of the preferred embodiment 50, FIGS. 4 and 5, of our inventive last round detection device can be easily ascertained by any person of ordinary skill in the art from the foregoing description, coupled with reference to the Figures of the drawings.

For others, it is sufficient to say in explanation, that when the feeler extensions 91 of all of the switch means 90, for sensing the presence or absence of a nose member of a round of unfired ammunition, extend simultaneously it means that the last unfired round 32, FIG. 5, has passed and that spent ammunition (i.e., the case member without a corresponding nose member) that have been transported from the gun 20 back to the drum 10 are in the convolutions (such as is indicated by 16D and 16E) in the helix 14. Therefore, as a result of the simultaneous extension of all of the feelers 91, all of the switch means 90 are in the "off" condition, because the extensions result in the opening of the switches, and the following sequential events occur: the flow of electricity to the slip ring 80 is interrupted (i.e., cut off); the logic circuit 140 closes the flow control valve 110; hydraulic fluid can no longer get from the reservoir 130 to the hydraulic pump 120; the gun 20 cannot continue to operate and therefore "coasts down" and stops; the helix 14 is no longer driven, so that the convolutions (such as 16A, 16B, 16C, 16D and 16E) stop rotating; and, spent ammunition (i.e., the empty case members) are prevented from being chambered into the gun 20.

CONCLUSION

It is abundantly clear from all of the foregoing, and from the Figures of the drawings, that the stated and desired principal object, as well as other related objects, of the invention have been achieved.

It is to be noted that, although there have been described and shown the fundamental and unique features of our invention as applied to a preferred embodiment, various other embodiments, variations, adaptations, substitutions, additions, omissions, and the like, may occur to, and can be made by, those of ordinary skill in the art, without departing from the spirit of the invention. For example: (a) the means 90 could include proximity sensing devices in lieu of the feeler extensions 91; and, (b) the inventive device 50 can be adapted for use with any other type of gun-helix power means for driving the helix, rather than by the hydraulic power means 100 shown in FIG. 4.

What is claimed is:

1. A last round detection device for use with an ammunition storage drum for a modern multi-barrel high rate-of-fire machine gun, wherein said ammunition storage drum contains unfired ammunition rounds for said gun, including a last round, and wherein each said round of unfired ammunition includes a case member and a nose member releasably fitted to said case member, and also wherein said ammunition storage drum has a longitudinal axis and an ammunition exit unit and includes an exit drum cover, an exit scoop disc, and an internally disposed rotatable helix which is rotated and operated by a power means and which has a core with convolutions carrying said unfired ammunition rounds, including said last round, and further wherein said ammunition storage drum is operatively connected to a means for handling and transporting said unfired ammunition rounds, including said last round, to said gun and for handling and transporting case members of spent ammunition rounds from said gun to said ammunition storage drum and to said helix convolutions, comprising:

a. support means disposed internal of said helix and connected thereto;

b. a tube assembly having a first end, a second end, and a longitudinal axis, with said tube assembly disposed such that said longitudinal axis of said ammunition storage drum and said longitudinal axis of said tube assembly are coincident, wherein said tube assembly extends through said exit scoop disc and inwardly into said ammunition storage drum and into said helix, and is attached to said support means by said second end;

c. a self-contained electrical slip ring assembly releasably secured to said exit drum cover, with said slip ring assembly inserted into said tube assembly through said first end thereof, and linked to said power means for rotating and operating said helix;

d. and, a plurality of means for sensing the presence and absence of a nose member of a round of unfired ammunition in said helix convolutions, with each one of said plurality of nose member sensing means mounted on said support means internal of said helix, disposed at a preselected angle to each other, and also disposed such as to monitor said helix core in between said helix convolutions for a nose member of a round of unfired ammunition, with each one of said plurality of nose member sensing means in electrical connection with said self-contained slip ring assembly;

whereby, as long as any one of said plurality of nose member sensing means senses the presence of a nose member, including said nose member of said last round, power to said helix is continued and said helix rotates and operates, and whereby when said plurality of nose member sensing means all simultaneously sense the absence of a nose member and thereby verify that said last round has passed all of said sensing means, all said sensing means signal said absence of a nose member, thereby resulting in cut off of power to said helix which then ceases to rotate and to operate, and thereby any case member of a spent ammunition round is prevented from being chambered into said gun.

2. A last round detection device, as set forth in claim 1, wherein said support means is a bracket assembly.

3. A last round detection device, as set forth in claim 2, wherein said bracket means includes a round plate that is vertically positioned with reference to said tube assembly longitudinal axis, and is mounted on said core of said helix.

4. A last round detection device, as set forth in claim 1, wherein each of said plurality of means for sensing the presence and absence of a nose member of a round of unfired ammunition in said helix convolutions includes an electromechanical switch which further includes a feeler extension that protrudes through said helix core and in between said helix convolutions.

5. A last round detection device, as set forth in claim 4, wherein said plurality of means for sensing the presence and absence of a nose member of a round of unfired ammunition in said helix convolutions are two in number and are identical.

6. A last round detection device, as set forth in claim 5, wherein said preselected angle is 180 degrees, such that said two sensing means are disposed opposite to each other.

* * * * *